US007416517B2

(12) United States Patent
Mitchell

(10) Patent No.: US 7,416,517 B2
(45) Date of Patent: Aug. 26, 2008

(54) INTERACTIVE MARTIAL ARTS TRAINING APPARATUS

(76) Inventor: Donald W. Mitchell, 24650 Amador St., #143, Hayward, CA (US) 94544

( * ) Notice: Subject to any disclaimer, the term of this patent is extended or adjusted under 35 U.S.C. 154(b) by 596 days.

(21) Appl. No.: 10/781,282

(22) Filed: Feb. 17, 2004

(65) Prior Publication Data

US 2004/0176222 A1 Sep. 9, 2004

Related U.S. Application Data

(60) Provisional application No. 60/451,547, filed on Mar. 4, 2003.

(51) Int. Cl.
*A63B 69/24* (2006.01)
*A63B 69/34* (2006.01)

(52) U.S. Cl. ..... 482/90; 482/87; 482/89; 384/245

(58) Field of Classification Search ..... 482/23, 482/33, 34, 36–38, 83–90; 472/1, 14, 15, 472/29, 35; 273/359, 440, 440.1; 384/245; 473/441; D21/830; 211/1.54, 1.55, 205; 446/236

See application file for complete search history.

(56) References Cited

U.S. PATENT DOCUMENTS 825,860 A * 7/1906 McKenzie ..... 482/90
1,564,734 A * 12/1925 Weiler ..... 211/172
2,435,864 A * 2/1948 Adams ..... 482/90
2,696,383 A * 12/1954 Noftsinger ..... 473/441
3,096,979 A * 7/1963 Lacy ..... 482/92
3,268,223 A * 8/1966 Woodsum, Jr. ..... 472/14
4,889,246 A * 12/1989 Lee ..... 211/163
5,389,057 A * 2/1995 Zagata, Jr. ..... 482/83
5,458,552 A * 10/1995 Mara ..... 482/90
5,679,103 A * 10/1997 Pratchett ..... 482/83

(Continued)

FOREIGN PATENT DOCUMENTS

FR 2763251 A1 * 11/1998

(Continued)

OTHER PUBLICATIONS

Stand Alone Spinning Wing Chun Dummy, Kung Fu Magazine, Fall 2002, vol. 8, No. 4, p. 53, Wing Lam Enterprises, Inc. Sunnyvale, CA 94087.

*Primary Examiner*—LoAn H. Thanh
*Assistant Examiner*—Victor K Hwang
(74) *Attorney, Agent, or Firm*—Foothill Law Group; Howard E. Lebowitz

(57) ABSTRACT

The invention pertains to a martial arts training device, a kit for assembling the device, and a method of using the device. The device includes a vertical elongate shaft supported by a rotary bearing, the rotary bearing supported by a base such that the shaft can rotate freely 360 degrees in either direction, the device including at least four arms, each arm extending out from the shaft at about a right angles thereto, the arms being located in spaced apart relationship both with respect to the length of the shaft and with respect to orientation around the shaft in a plane normal to the shaft, wherein each arm after a first arm has a predecessor arm along the shaft, and each arm after the first arm is rotated at least 60° with respect to its predecessor arm.

6 Claims, 3 Drawing Sheets

U.S. PATENT DOCUMENTS

| | | | | |
|---|---|---|---|---|
| 6,872,171 | B2 * | 3/2005 | Haselrig | 482/83 |
| 7,086,997 | B1 * | 8/2006 | Fields et al. | 482/90 |
| 7,150,700 | B2 * | 12/2006 | MacKay et al. | 482/83 |
| 2005/0124469 | A1 * | 6/2005 | Melvin | 482/83 |
| 2006/0025284 | A1 * | 2/2006 | Livingstone et al. | 482/83 |

FOREIGN PATENT DOCUMENTS

| | | | |
|---|---|---|---|
| SU | 2019230 | C1 * | 9/1994 |
| WO | WO 2004096381 | A1 * | 11/2004 |

* cited by examiner

INTERACTIVE MARTIAL ARTS TRAINING APPARATUS

This application claims the benefit of my Provisional Patent Application Ser. No. 60/451,547 filed on Mar. 4, 2003.

BACKGROUND OF THE INVENTION

1. Field of the Invention

The invention pertains to an interactive training device for martial arts training and physical conditioning.

2. Description of the Prior Art

Traditional martial arts disciplines such as Karate and Kung Fu or Tae-kwan-do are based on learning and practicing katas. Katas are systematic standardized series of defensive and offensive movements, including hand and kicking motions, performed in sequence against one or more imaginary opponents. The katas are repeated and learned and once learned become the methods for defending from a real attack. The katas can be practiced on special standardized wooden dummies, consisting of a vertical wooden shaft having three arms extending horizontally from the vertical shaft, and a leg extending outward and then down to the floor. The top two arms are at about shoulder level and displaced from each other by about 32 degrees, approximating an opponent's outstretched arms. The third arm is at mid torso level, roughly aligned with one of the top two arms. A "leg" is directed outward from the vertical shaft at about knee level and then downward towards the floor. The leg is aligned with the two aligned horizontal arms. A martial arts practitioner practices katas by striking and kicking the arms and leg. It is important to note that all of the action of a wooden dummy is confined to a 32 degree sector of the circumference of the vertical shaft. In one type of wooden dummy, the vertical shaft is supported by a wooden framework with attachments for wall mounting. In a second type of wooden dummy known as a spinning dummy or a spinning "Wing Chun" dummy, the vertical shaft is mounted in a bearing within a small base, such that the vertical shaft can rotate and such that the dummy is free standing. Both fixed and spinning dummies have a common arrangement of the shaft, arms and legs.

U.S. Pat. No. 5,679,013 discloses a device for combat training having a fixed vertical shaft with at least one elongate cross arm pivotally extending through the shaft on both sides, so that when one end of the cross arm is struck by a user the cross arm rotates around and the user is required to defend against being struck by the other end of the cross bar.

U.S. Pat. No. 5,277,679 discloses a device for practicing Karate strikes with a horizontal target mounted on a vertical shaft, the shaft having a mechanism which resists rotation such that when the target is struck it has a range of motion and the snaps back to its original position.

U.S. Pat. No. 5,722,920 discloses a plurality of targets attached to and extending away from a stationary vertical shaft, wherein the targets are connected with connectors which allow a target to move when struck and then spring back to the original position.

These and other training devices are effective in allowing a user to practice kata movements and to gain skill in applying hand and foot strikes. However, the prior art training devices do not provide a training dummy that provides a martial arts practitioner with a full body dynamic training session where his offensive and defensive fighting timing, coordination and instincts are developed without the need to learn a particular series of predefined movement patterns such as katas.

There is a need for a martial arts training device that provides a practitioner with a continuous dynamic training session to practice both offensive and defensive attacks over a wide range of the body with continuous interactions from shoulder to knee level.

There is a need for a martial arts training device that allows a practitioner to develop offensive and defensive fighting techniques, timing and instincts which are not tied to certain predefined movement patterns.

There is a need for a martial arts training device that provides a continuous dynamic training to practice both offensive and defensive attacks over a wide range of the body with continuous interactions from shoulder to knee level which is easy and intuitive to use and inexpensive to build.

SUMMARY OF THE INVENTION

One object of the invention is a martial arts training device that provides a practitioner with continuous dynamic training to practice offensive and defensive attacks over a wide range of the body from shoulder to knee level.

Another object of the invention is a martial arts training device that allows a practitioner to develop offensive and defensive fighting techniques, timing and instincts which are not tied to certain predefined movement patterns.

Another object of the invention is a martial arts training device that is easy and intuitive to use and inexpensive to construct.

One aspect of the invention is a martial arts training device, including:

a. an elongate shaft, b. at least four arms, each arm extending at approximately a right angle from the shaft, the arms being located in spaced apart relationship both with respect to the length of the elongate shaft, and with respect to orientation around the shaft in a plane normal to the shaft, wherein each arm after a first arm has a predecessor arm along the shaft, and each arm after the first arm is displaced by at least 60° with respect to its predecessor arm, and at least one arm extends into each quadrant of a circle whose center is the elongate shaft;

c. a first rotary bearing, and d. a base, the base supporting the first rotary bearing and the first rotary bearing supporting the elongate shaft, wherein the shaft is approximately vertical when supported on the base and is capable rotating 360° in either direction.

The arms are preferably spaced roughly evenly along the length of the shaft to correspond to positions along the shaft between a position corresponding roughly to a user's head and a position corresponding roughly with a user's knees, when the shaft is in the vertical position supported on the base. Generally four arms are preferred for a unit suitable for a child, while six arms are preferred for a unit suitable for an adult. Successive arms are preferably at least 60 degrees apart from each other, and at least one arm should extend into each quadrant of a circle with the elongate shaft at the center of the circle. It is highly preferable that the first rotary bearing should be of such a quality that the shaft turns smoothly and with little resistance. The arms and shaft are preferably padded.

The device may be supported free standing on a single rotary bearing supported by a heavy base, or alternatively between the first rotary bearing and a second rotary bearing, the second rotary bearing mounted in a top support. In the latter version, typically the base and top support will be attached to a floor and ceiling respectively. The freestanding model is most convenient for home use while the alternative model is more suitable for use in a fixed location.

The device can be an assembled unit or it may be a kit of parts ready for assembly.

Another aspect of the invention is a method for using the training device described previously to gain skill in martial arts combat. The method differs from prior art methods of using a wooden dummy, in that the device is not designed for practicing predefined kata movements, but rather the device provides a dynamic response to an initial strike by a user, in that when the user strikes an arm of the device, the shaft rotates so that user needs to immediately respond with an appropriate block or himself be struck by one or more other arms. In turn when the user blocks the device the rotation puts him in position to be struck immediately by another arm. This sequence continues indefinitely. The user controls the intensity of a workout by the impulse applied to each strike. The greater the impulse applied to a strike by the user, the more momentum applied to the device and the higher the intensity of the response from the device.

A method for a user gaining skill in martial arts combat including steps of:

a. striking an arm of a training device, wherein the training device includes a vertical elongate shaft supported by a rotary bearing supported by a base such that the shaft can rotate freely in 360 degrees, the device including at least four arms, each arm extending out from the shaft at about a right angles thereto, the arms being located in spaced apart relationship both with respect to the length of the shaft and with respect to orientation around the shaft such that each arm after a first arm has a preceding arm, and each arm is displaced by at least 60° from its preceding arm and at least one arm extends into a circle whose center is the elongate shaft;
b. the user allowing the shaft to rotate until a next arm comes within striking distance of the user;
c. the user attempting to strike the next arm before it hits the user; and
d. repeating steps b and c.

A user improves the martial arts skill by striking a next arm with greater impulse (higher velocity of the strike and/or higher force applied that makes the shaft come around all the faster). The device thus provides a dynamic response to the user since as the user's ability improves (measured by the user being able to strike the unit with greater force and velocity), the next arm comes around faster and is more difficult to parry.

An important feature of the method, which is facilitated by the spaced apart relationship of the arms, is that a user will learn to deflect different attacks including:

a. protection of the head area to deflect a strike from above,
b. protection of the upper and middle body by deflecting a strike by bringing the arms across the body from low outside,
c. protection of the upper and middle body by deflecting a strike by bringing the arms from low inside, and
d. protection against a low punch or kick.

BRIEF DESCRIPTION OF THE DRAWINGS

These and other features, aspects and advantages of the present invention will become better understood with regard to the following description, appended claims and accompanying drawings, where:

DESCRIPTION OF THE PREFERRED EMBODIMENTS

One aspect of the invention is a martial arts training device comprising a elongate shaft supported by at least one rotary bearing supporting the shaft and a base supporting the rotary bearing such that the shaft is free to rotate 360 degrees in either a clockwise or counterclockwise direction. The device further comprises at least four arms extending out at roughly right angles from the shaft. When the device is in normal use, the base will rest on a roughly horizontal surface such as a floor or outside earthy surface and the shaft extends vertically from the base. The device is preferably constructed such that when so situated, the top arm is at about head level of an intended user and the bottom arm is somewhere between mid-thigh and knee level. The other arms are spaced apart along the length of the shaft between the top arm and the bottom arm, preferably in roughly equal spacing, though equal spacing is not required. The arms are preferably about one to about three feet long more preferably about two feet long. The arms are also spaced apart in angular position around the shaft, so that successive arms are displaced from each other, by at least 60 degrees, and wherein at least one arm extends into each segment of a circle with the elongate shaft at its center.

The number of arms depends on the height of user that it is anticipated to use the device. It is preferred that the arms range from somewhere on the head to somewhere between about mid thigh and knee level, and other arms are roughly evenly spaced apart along the shaft. In a practical sense, from four to six arms are generally preferred. A four arm unit is often ideal for a child (about 4.3 to about 5.3 feet tall), while a six arm unit is often preferred for an adult (about 5.3 to about 6 ft. tall).

The device can be free standing on a large weighted base or alternatively supported between a top support and the base that are attached to two surfaces such as a ceiling and floor or on a support frame, with the shaft supported between two rotary bearings. Preferred rotary bearings are ball bearings and roller bearings.

The device may be assembled or it may be a kit of parts ready for assembly. Freestanding devices are particularly suitable for being made as a kit of parts which can be assembled and reassembled.

Figure 1:
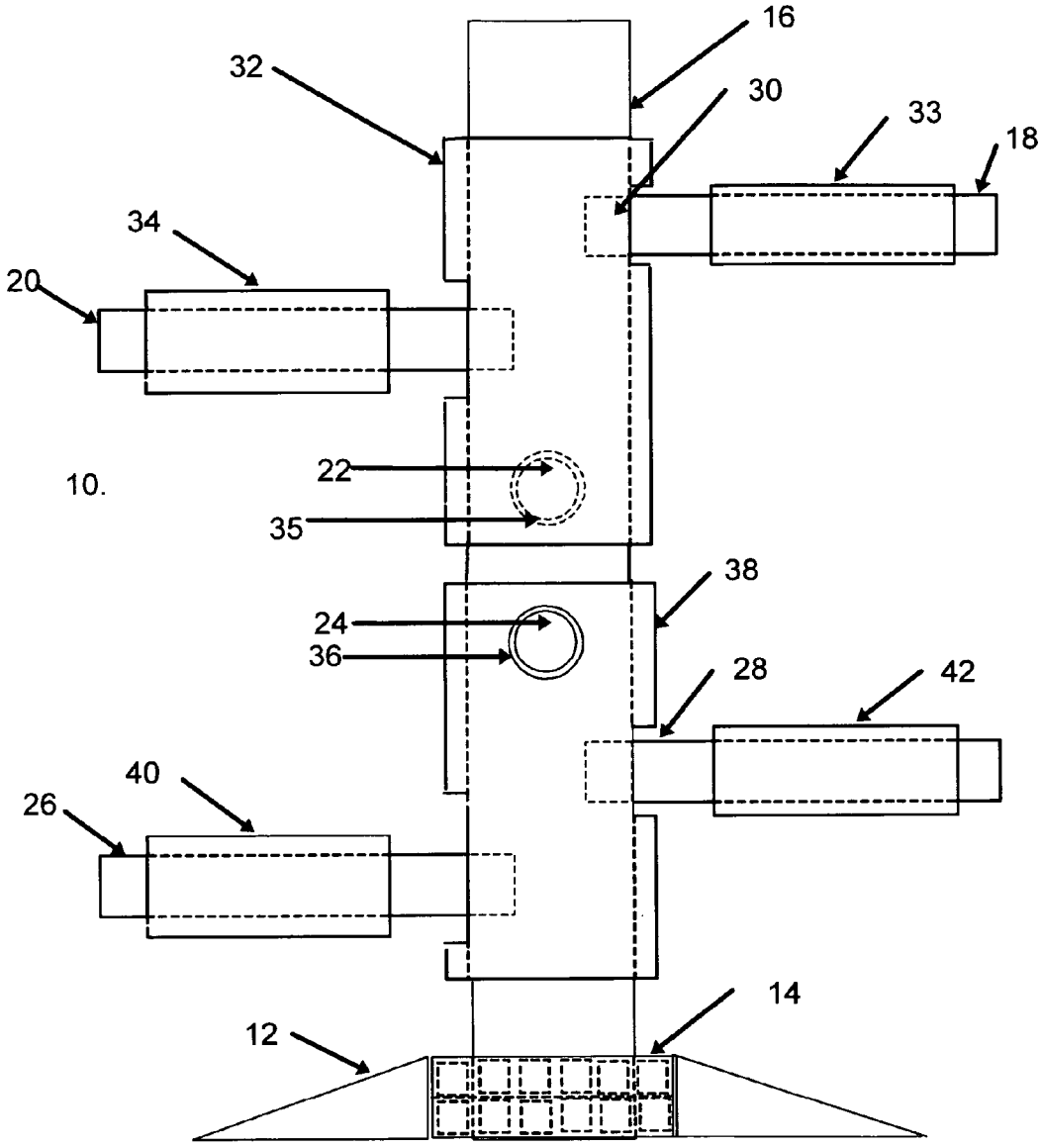
FIG. 1 is a front view of a preferred embodiment of the martial arts training device with six arms and a stand-alone configuration with a single roller bearing.

Referring to the figures, FIG. 1 shows a front view of a martial arts training device 10 of the stand alone type. The device has a base 12 which has a weight and profile chosen so that the device will remain stable during use. An alternative base is a smaller base that can be anchored to the floor, such as a piece of metal plate or a wooden rectangle with holes for bolting to the floor.

A bearing 14, shown in the figure as a roller bearing, is inserted into the base, preferably a press fit, and a shaft 16 is supported inside the inner bore of the bearing. The bearing could also be a ball bearing rather than a roller bearing. The shaft preferably has a circular cross section to fit snugly into the bore of the bearing, though an alternative is for the shaft to have a different size or shape than the bearing bore and a transition piece to fit into the bearing. The shaft is preferably made of wood, though metal or hard plastic are alternatives. It is important that the arrangement of shaft bearings and base allow free and smooth rotation of the shaft a full circle in both clockwise and counterclockwise directions.

Six arms 18, 20, 22, 24, 26 and 28 extend out from the shaft at approximately right angles to the shaft. The arms preferably extend straight out from the shaft, they should preferably not be curved or bent. The arms are shown attached to the shaft by pressing them into holes in the shaft such as hole 30 that accommodates the topmost arm. Arms may be glued into the holes, for a permanent installation. Alternatively the holes and ends of the arms may be threaded and screwed together, which allows for ease of removal. Screwed together construction is particularly desirable for a unit that can be assembled, disassembled and reassembled by a user. Arms can also be attached with various brackets that are attached to the shaft and are well known in carpentry art. Arms are preferably wooden. Note that the length of the arms is long enough so that they extend past the edge of the base so that a user can strike the arms or be hit by arms when standing next to the device. Arms preferably extend about six to eighteen inches beyond the base.

The arms are in spaced apart relationship along the length of the shaft, preferably roughly evenly spaced apart, although exact even spacing is not necessary and a preferred arrangement for six arms is to have the space between the top two arms and the bottom two arms smaller than the other spaces. The arms are also each spaced apart in orientation around the shaft as viewed in a horizontal plane with the shaft at its center. In FIG. 1, shows a preferred embodiment where each arm extends approximately from a 90 degree quadrant boundary around a circle with the center of the elongate shaft at its center. Thus if the topmost arm is at 0°, the remaining arms are oriented at 180°, 270°, 90°, 360°, and 540°. Successive arms should be at least about 60° apart and preferably either 90° or 180° apart so as to be at quadrant boundaries. Other orientations for the arms are also possible and give different training effects. For a six arm adult unit, the top arm is typically at about face level, typically about 60 to 65 inches above ground level. The bottom most arm should be preferably at mid thigh, typically about 30 inches above the ground. Arms are preferably 14 to about 18 inches long, more preferably about 16 inches long in a preferred embodiment. The top two arms and the bottom two arms are preferably spaced apart about 3 to about 6 inches from each other, the other arms from about 4 to about 9 inches apart. The exact spacing is not critical but have shown to provide smooth action for an approximately 5 ft. 8 inch adult.

It is preferred that the shaft and arms be padded. While, it is customary to practice martial arts strikes, such as karate, on a wooden dummy, the device of this invention is intended for a continuous dynamic use which might be too stressful to a user if not padded. The padding can be a preformed shock resistant plastic or a "wrap-around" plastic layers to protect a user's body. Padding elements 32, 33, 34, 35, 36, 38, 40, and 42 are shown in FIG. 1. A preferred size for an arm is about 1 to about 2 inch diameter with about 1 to 2 inches of high quality padding such as polyurethane.

Figure 2:
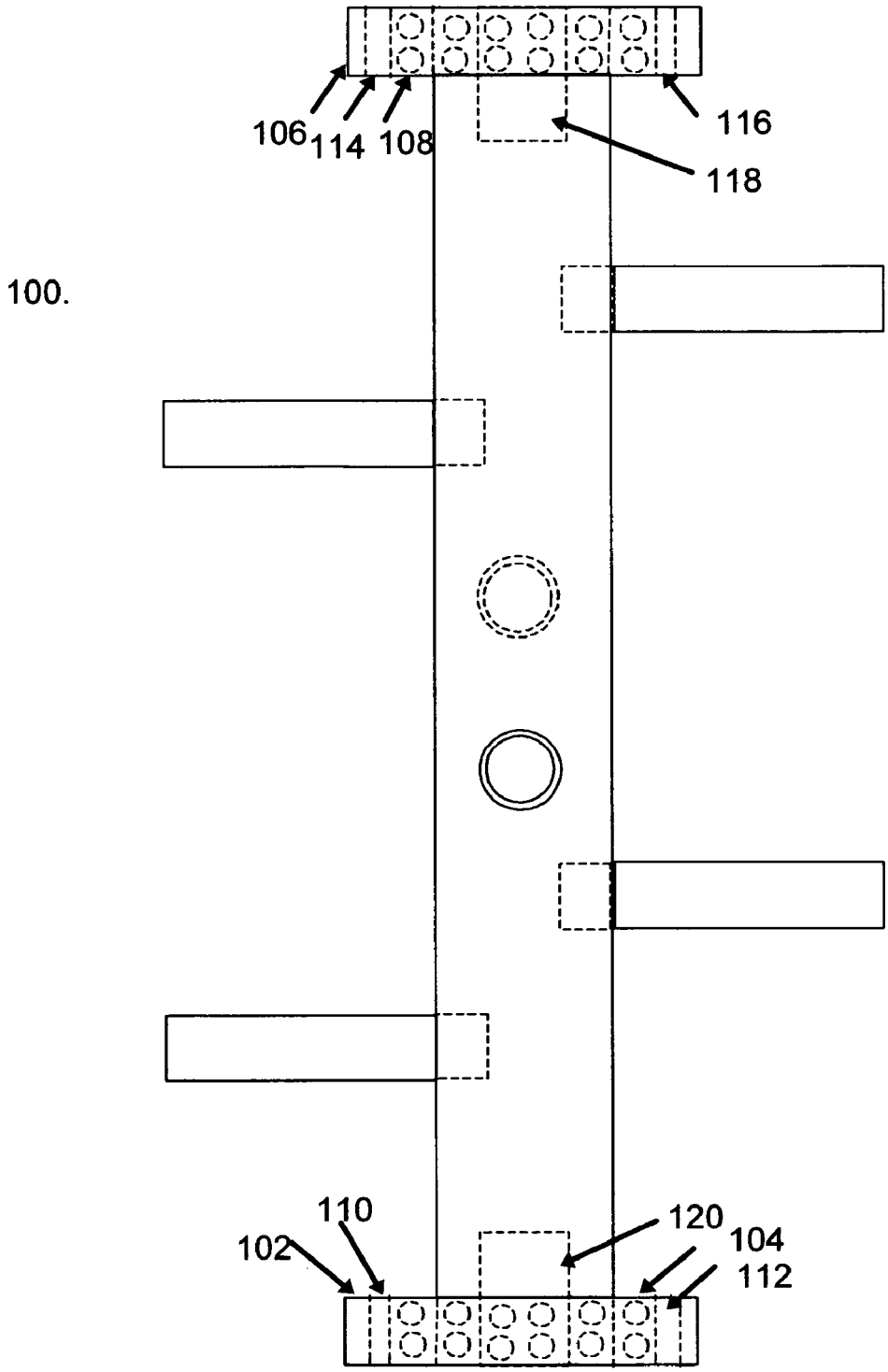
FIG. 2 is a front view of a variation of the preferred embodiment of the six arm training device in a two roller bearing version which can be fixed to a floor and ceiling.

FIG. 2 shows an alternative variation of the martial arts device. In FIG. 2, the device 100 further comprises a top support 106 with a rotary bearing 108 therein, which supports the shaft in conjunction with the base 102 and rotary bearing 104 therein. In device 100, the entire shaft does not extend into bearings 104 and 108, but rather only inserts in the shaft, 120 and 118 respectively, extend into the bearings. This arrangement is adequate to support the shaft when top and bottom bearings are used. This device 100 differs from device 10 in FIG. 1 in that it is not free standing and contemplates the top support and base being attached to structures such as a ceiling and floor respectively or fixtures on a support frame. The bearings are shown as ball bearings. The base has bolt holes 110 and 112 and the top support has bolt holes 114 and 116 for external attachment. The device is otherwise identical with device 10 on FIG. 1. Padding is not illustrated on this device for clarity, though padding is preferably supplied as in device 10 on FIG. 1.

Figure 3:
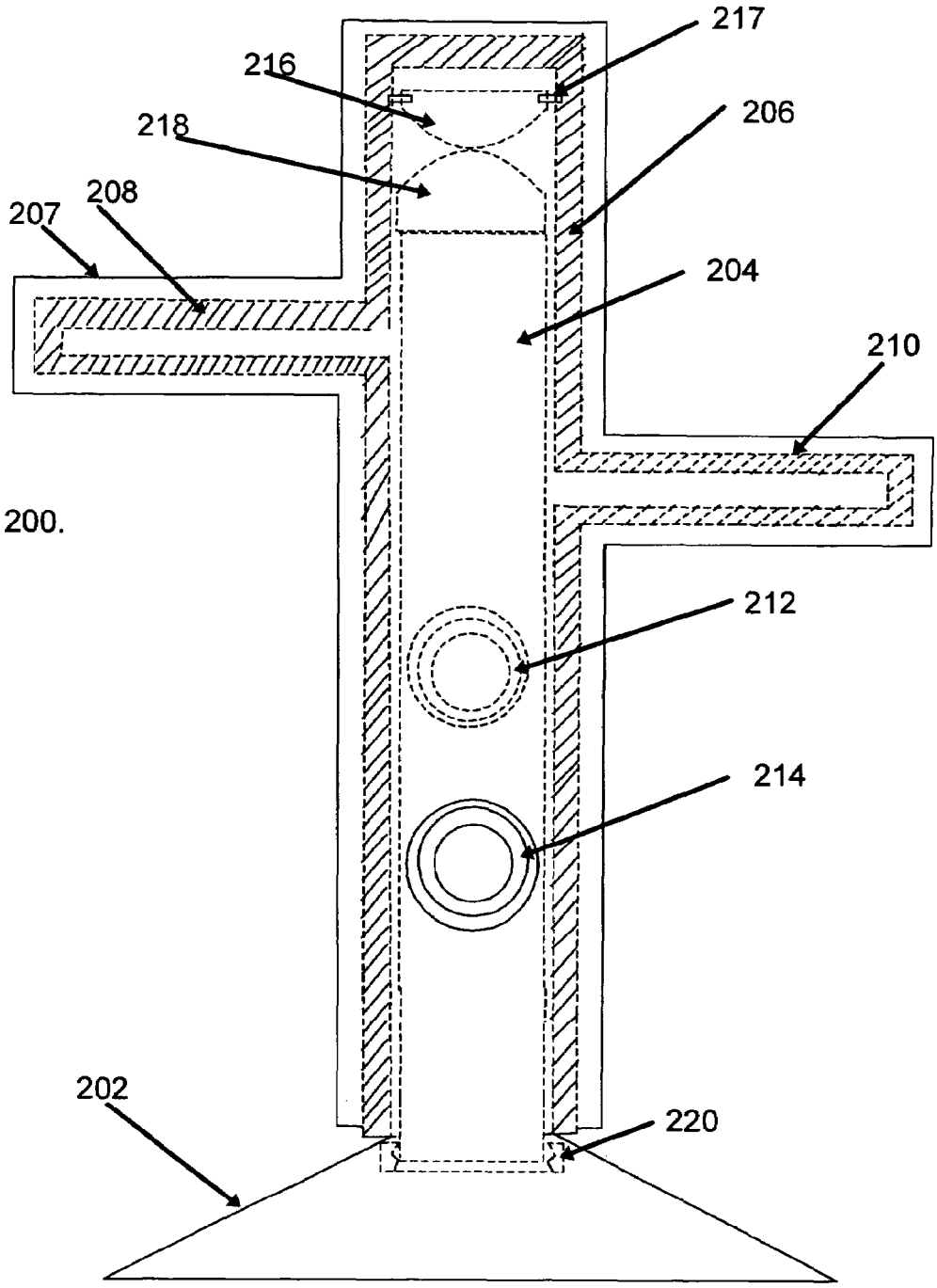
FIG. 3 is a front view of a four arm training device in the stand-alone configuration with an alternative rotary bearing.

FIG. 3 shows a four arm, freestanding martial arts training device 200. Device 200 comprises a freestanding base 202; the base 202 further includes a fixed position shaft 204 screwed into threaded socket 220 in the base. The device further includes a rotating shaft 206 that is hollow and fits over the fixed shaft 204. The rotating shaft 206 is supported on the fixed shaft portion of the base by a bearing which comprises two parts 216 and 218 that are each cup like structures each having a hollow cylinder closed at one end by a curved surface which matches the curved surface on the other structure. Bearing part 216 is fixedly attached to the rotating shaft 206 by fasteners 217. Part 218 is press fit over fixed shaft 204. The matched curved surfaces are preferably lubricated with heavy grease. Part 216 rotates on fixed part 218 allowing the rotary shaft to turn freely. The arms 208, 210, 212, and 214 extend from the rotating shaft and may be integral parts or attachments. The length of the arms is such that they extend beyond the base when the device is supported upright on the base. The rotating shaft is preferably made from preformed plastic and may be a single preformed piece of molded plastic or alternatively may be readily made of plastic pipe and fittings assembled to make the shaft and arms. In either alternative, the rotating shaft should fit over the fixed shaft. Padding 207 covers the rotating shaft.

The unit illustrated may be constructed for use by children (or small adults). A typical height of the topmost arm from ground level is about 44 to 50 inches.

A preferred material for the fixed shaft is wood, though metal and hard plastic are alternatives. A preferred material for the rotating shaft is plastic pipe and fittings with an inside diameter that will fit over the fixed shaft. A plastic shaft cover serves as padding for the shaft. The base is preferably a heavy weighted base such as made of steel, or a plastic base that can be filled with a heavy filling. The rotating shaft and arms can be readily fabricated using plastic piping and fittings. A preferred size is two-inch pipe. About 1 to 2 inches of high quality padding is preferred.

Device 200 is readily disassembled and reassembled. The unit is assembled by screwing the fixed shaft 204 into the threaded socket in the base, pressing bearing part 218 onto the top of the fixed shaft, attaching matching bearing part 216 to the rotating shaft with fasteners 217, and slipping the rotating shaft 206 and arms over the fixed shaft. The arms may also be detachable from the rotating shaft. Another aspect of the device 200 is a kit of parts suitable for assembly.

Another aspect of the invention is a training method for practicing martial arts using a martial arts training device of the invention.

The device is used to progressively develop a practitioner's defensive skills developing hand and eye coordination to create an instant blocking reaction for strikes from head to knee level. The device is powered by the impulse of a practitioner's strikes to an arm of the device, the speed and force of the strike impart a momentum to the device, which cause the shaft to spin and another arm to come into striking range to either be blocked by the practitioner or to hit the practitioner. As a practitioner gains skill he blocks with increasing force and velocity imparting greater momentum to the device and a more rapid and powerful response. Each strike by a practitioner results in a unique dynamic response from the device.

Important blocking maneuvers include the overhead block, the inside block, the outside block, and the downward block.

The overhead block protects the head area against any strike from above. The object is to deflect the strike to the side rather than being under the strike as it comes down.

The inside block is used to deflect a strike to the mid-body area. The block is performed by bringing the arm across the body from low outside to inside with a circular motion.

The outside block is also used to deflect a strike to the mid-body area. This block is performed by starting with the hands low and coming up in a circular motion from the inside to the outside.

The downward block is used to deflect a punch or kick from below. This block is performed by bringing the forearm down across the body from the inside to the outside. All of the blocks can be performed left hand or right hand depending on the direction of rotation of the shaft.

A method for using a spinning martial arts training device for improving a practitioners skill including the practitioner performing the acts of:

1. standing near a martial arts training device wherein the martial arts training device includes a vertical elongate shaft supported by a rotary bearing, the rotary bearing supported by a base such that the shaft can rotate freely 360 degrees in either direction, the device including at least four arms, each arm extending straight out from the shaft at about a right angles thereto, the arms being located in spaced apart relationship both with respect to the length of the shaft and with respect to orientation around the shaft in a plane normal to the shaft, wherein each arm after a first arm has a predecessor arm along the shaft, and each arm after the first arm is rotated at least 60° with respect to its predecessor arm and at least one arm extends into each quadrant of a circle with the shaft at its center;
2. striking an arm of the device;
3. allowing the shaft to rotate until a next arm comes within striking distance;
4. attempting to strike the next arm before hit by the next arm; and
5. repeating steps 2,3 and 4.

The practitioner improves his performance in the martial arts by striking a next arm with progressively greater impulse so as to impart a progressively higher velocity to the spinning shaft and improving his skill by combating the dynamic response of the device.

It can be seen that the martial arts training device according to the invention provides a practitioner with continuous dynamic training to practice offensive and defensive attacks over a wide range of the body from shoulder to knee level. By using the device a practitioner to develops offensive and defensive fighting techniques, timing and instincts which are not tied to certain predefined movement patterns. The device is easy and intuitive to use and inexpensive to construct.

Although the present invention has been described in considerable detail with reference to certain preferred versions thereof, other versions are possible and will be apparent to those skilled in the art. Therefore the spirit and scope of the appended claims should not be limited to the preferred versions herein.

What is claimed is:

1. A martial arts training device, comprising:

a. an elongate shaft;

b. at least four arms, each arm extending at approximately a right angle from the shaft, the arms being located in spaced apart relationship both with respect to the length of the elongate shaft, and with respect to orientation around the shaft in a plane normal to the shaft, wherein each arm after a first arm has a predecessor arm along the shaft, and each arm after the first arm is rotated at least 60° with respect to its predecessor arm and wherein at least one arm of the at least four arms extends into each quadrant of a circle with the elongate shaft at its center;

c. a first rotary bearing; and d. a base, the base supporting the first rotary bearing and the first rotary bearing supporting the elongate shaft at an end thereof such that the shaft is capable of 360° rotation; and e. wherein the first rotary bearing comprises two opposed cup structures each structure comprising a hollow cylinder closed at one end by a curved surface.

2. The martial arts training device of claim 1, wherein the martial arts training device is free standing.

3. The martial arts training device of claim 1, wherein the at least four arms consist of exactly four arms.

4. The martial arts training device of claim 1, wherein the at least four arms are spaced apart with respect to orientation around the shaft such that each arm extends from the elongate shaft at approximately a quadrant boundary of a circle with the elongate shaft at its center.

5. The martial arts training device of claim 1, wherein the at least four arms have a topmost arm and three succeeding arms oriented at 0°, 180°, 270°, and 90° respectively with respect to a circle having the elongate shaft at its center.

6. The martial arts device of claim 1, wherein the device further comprises padding covering portions of the at least four arms.

* * * * *